US005897000A

United States Patent [19]

Leanza

[11] Patent Number: 5,897,000

[45] Date of Patent: Apr. 27, 1999

[54] ADJUSTABLE NAPKIN HOLDER

[76] Inventor: Frank J. Leanza, 12927 Pipe Run Dr., Fredericksburg, Va. 22407

[21] Appl. No.: 08/953,746

[22] Filed: Oct. 17, 1997

[51] Int. Cl.[6] ..... A47F 7/00

[52] U.S. Cl. ..... 211/50; D7/631; 211/43

[58] Field of Search ..... 211/40, 41.12, 211/51, 50, 43, 49.1; D7/631; D19/34.1

[56] References Cited

U.S. PATENT DOCUMENTS

D. 369,528 5/1996 Brooks ..... D7/631

2,603,357 7/1952 Zakos ..... 211/43

5,221,011 6/1993 Coto ..... 211/51

*Primary Examiner*—Robert W. Gibson, Jr.

[57] ABSTRACT

A napkin holder comprised of two separate plates. Each plate is fastened with one pivot point to the same base. This pivot point is between the center and right end on one plate and between the center and the left end on the second plate. Thus, the pivot points being offset, will cause the plates to close when rotated in one direction and to open when rotated in the other direction.

4 Claims, 2 Drawing Sheets

ADJUSTABLE NAPKIN HOLDER

BACKGROUND

This patent relates to a typical napkin holder, with an added feature which allows the opening between the plates to be adjusted. Previous patents simulating this type of feature were very involved, cumbersome and in no way resemble the typical napkin holder that we are familiar with. Therefore they were not acceptable for general use. This napkin holder is not at all complicated and resembles the everyday holder presently found on the kitchen table. The beauty of this holder is that it will adjust to the exact amount of napkins present, holding them snug and upright, yet not so tight that they cannot be easily removed one at a time.

U.S. Pat. No. 5,221,011 describing an adjustable napkin holder does not have the simplicity or practicality of my invention. Neither does it have the strength or the eye appeal. It doesn't in any way resemble the typical napkin holder we are all familiar with. In the cited patent, the pivot posts are at the very end of a tubular holder. This is the only part that makes contact with the base. There is no contact between the horizontal element of the holder and the base. The holder is well above the base and is made up of rods and tubes. In total it is an extremely complicated make up of tubes, channels, rods and attachments.

In my invention the plates sit firmly on the base. The plates resemble those of a typical napkin holder. The pivots are offset being placed between the center and the end of the plate. FIG. 2 of the drawings shows the pivot to the right of center in the front plate and to the left of center in the back plate. To adjust the opening between the plates, the plates are rotated. When the plates are rotated clockwise they will come closer together and when they are rotated counter clockwise they will move apart.

U.S. Document References Cited,

U.S. Pat. No. 5,221,011 June 1991 Coto 211/51; 211/43.

U.S. Pat. No. 4,874,099 October 1987 Arnot and Kaga 211/50; 211/43; 211/184.

U.S. Pat. No. 3,800,958 April 1974 Dorn 211/43; 211/51; 211/181.

OBJECTS AND ADVANTAGES

This invention provides an extremely simple and reliable method to have a typical napkin holder on the table and yet one that will adjust to the amount of napkins in the holder. The typical napkin holder has two plates fastened to the base in an immovable position. Getting the proper amount of napkins into this opening takes several tries. It isn't unusual, after the right amount of napkins is established, they all have to be removed, readjusted and again inserted to give the uniform neat appearance desired. Also the adjustable holder can now use a slightly taller plate preventing the napkins from sagging over the plate in humid weather. Taller plates have been avoided because of the greater difficulty in inserting a full compliment of napkins into a conventional tall napkin holder. With the adjustable napkin holder the plates are opened to a larger than necessary distance to accommodate the amount of napkins to be inserted. After the napkins are inserted, the plates are closed to a point where the napkins are held upright, but can be easily removed. This is the optimum setting. As the napkins are used the distance between the plates becomes excessive. These napkins will now have a tendency to sag and belly in the middle. This condition, which is now very easily corrected with the adjustable holder, need not be a problem any longer. A slight turn and it will be back to optimum setting. There are no springs, grooves or tension to complicate the operation. The plates resemble the usual type napkin holder and are not a deviation from the norm.

Previous patents of adjustable napkin holders are quite complicated and do not resemble what is commonly accepted for use by the public. Further advantages of my invention will become more apparent from a consideration of the drawings and ensuing description.

Figure 1:
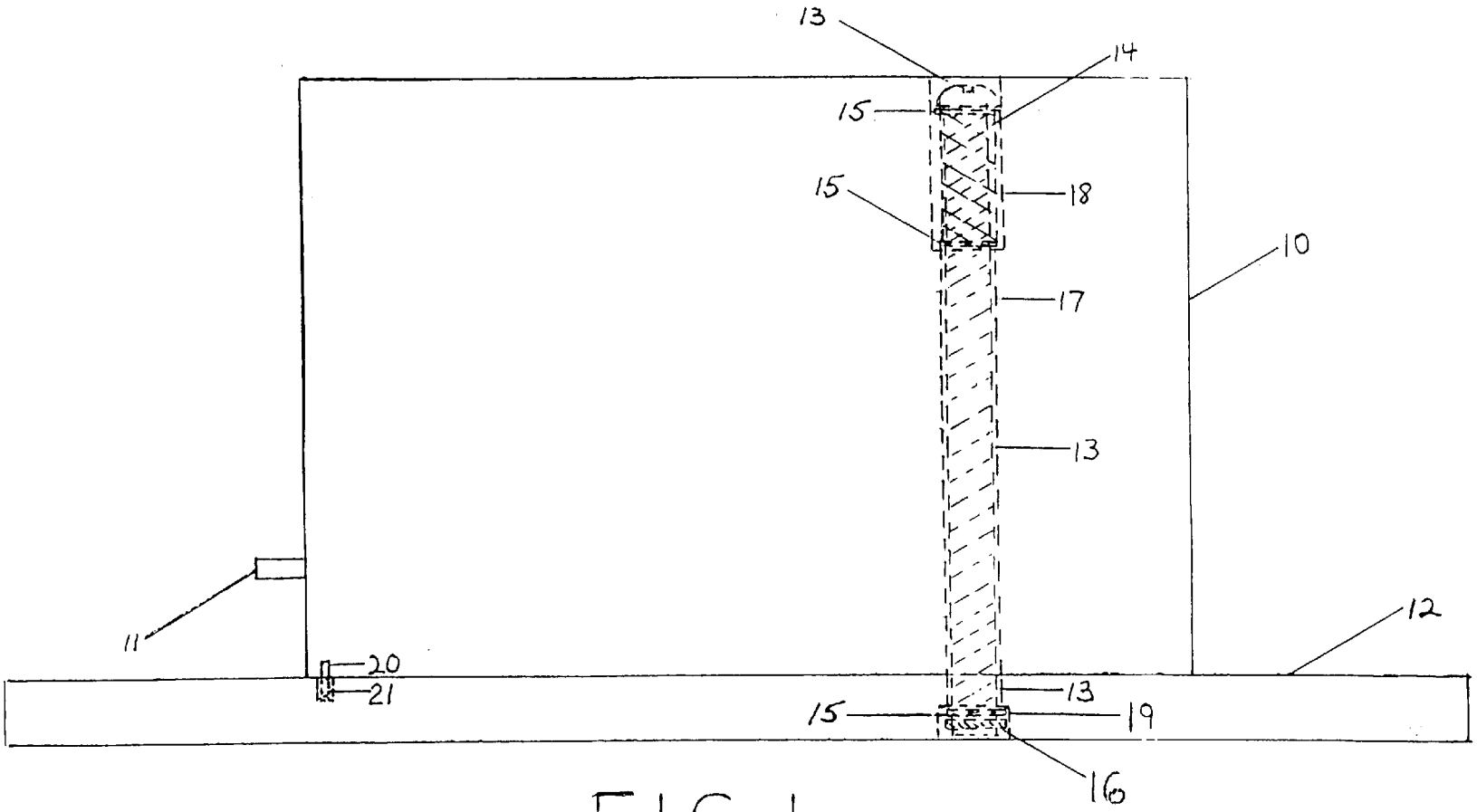
FIG. 1 is a front view showing front plate and its attachment to the base.

List of reference numerals,

10—Plates
11—Knob
12—Base
13—bolt
14—Tension spring
15—washer
16—Nut
17—Hole in plate 10 and base 12 between 18 and 19
18—Hole with slightly larger diameter than 17, attached and just above 17.
19—Hole with slightly larger diameter than 17, attached and just below 17.
20—pin
21—hole into which pin can be lowered

DESCRIPTION

Hole 18 extends down vertically from the top of the plate. It is located about midway between the center and the end of the plate. It is of a larger diameter than hole 17 to which it is attached. Hole 17 continues down and goes completely through the plate and into the upper section of the base where it joins hole 19. Hole 19 is also of a larger diameter than hole 17 and continues down through the base. The larger diameter of hole 19 is to accommodate the washer 15 and nut 16. The larger diameter of hole 18 is necessary to accommodate washer 15, tension spring 14 and another washer 15. These are located in hole 18 in that order. Washer 15 which is of a larger diameter than hole 17 sits right on top of hole 17. Bolt 13 goes through these and then continues through hole 17 and into hole 19 where it passes through washer 15 and is attached with nut 16. This is then tightened and locked so that there is the proper amount of compression exerted on the tension spring 14. This compression will hold the plate firmly against the base. The tension spring will maintain this pressure. The locking of the nut and bolt is to prevent them from tightening or loosening with use (rotation of the plates).

Figure 4:
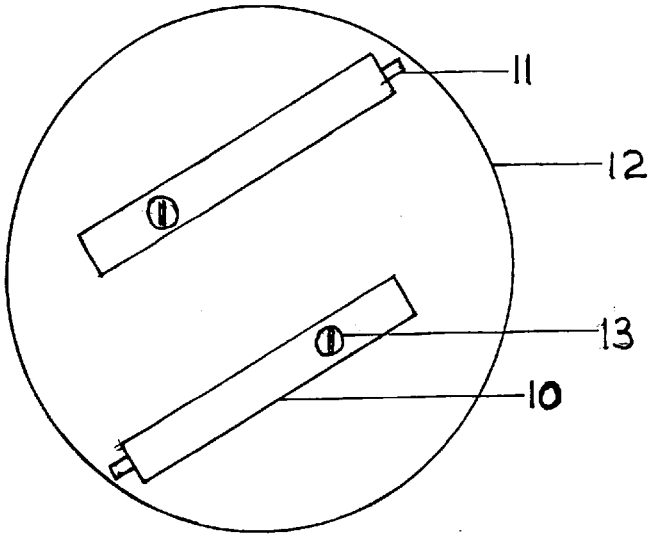
FIG. 4 is the same as FIG. 2 with plates in an opened position, having been rotated in a counter clockwise direction.
Figure 3:
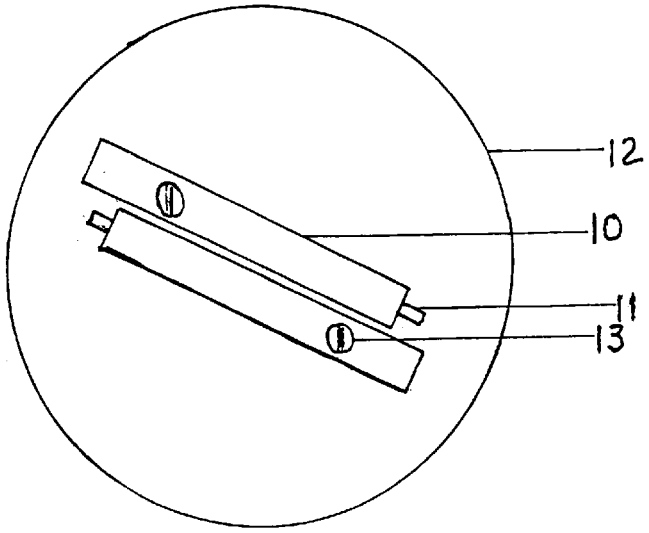
FIG. 3 is the same as FIG. 2 with plates in a closed position, having been rotated in a clockwise direction.
Figure 2:
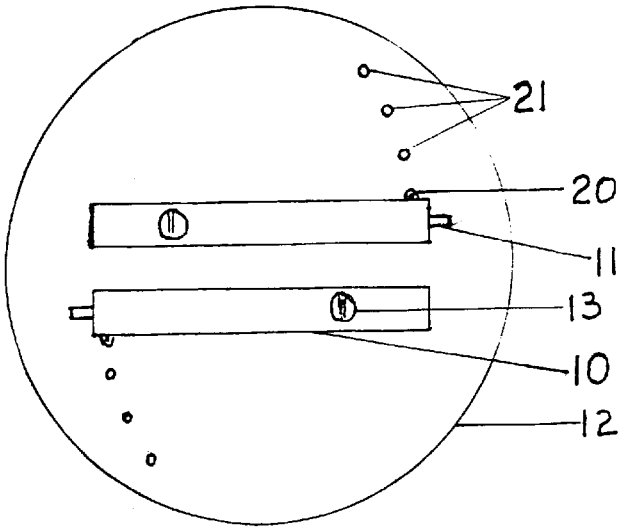
FIG. 2 is a top view in neutral position. Both plates are aligned and shows the offsetting of the pivot bolts.

The fastening of second plate is exactly the same, except that it is on the left of the center. FIG. 2, FIG. 3 and FIG. 4 show the offsetting of the two pivot points through the front and rear plates. It's the offsetting of these pivots that allows the holder to adjust. The knob 11 is used to facilitate the opening and closing of the plates. To open, the plates are rotated counter clockwise. This is done by placing the thumb of the right hand on knob 11 of the back plate and the index finger of the left hand on knob 11 of the front plate. The thumb is pushed away and the index finger is pulled forward while holding the base firm. This will take us from FIG. 2 to FIG. 3. To close the distance between the plates the opposite procedure is used placing left thumb on knob 11 of the front plate and the index finger of the right hand on knob 11 of the rear plate.

The tension spring will maintain the proper amount of pressure to keep the plates held tight up against the base, keeping them from rotating freely and yet easily adjustable.

OPERATION OF INVENTION

To place the napkins in the holder, the plates are opened to a point which is greater than the amount of napkins to be inserted. The napkins are then easily placed in the holder. The plates are then rotated clockwise until they loosely touch the napkins (optimum setting). At the optimum setting the napkins will be held neatly and still be able to be withdrawn one at a time. As the napkins are used, the plates can again be easily closed to the point of optimum setting. In this way the napkins will always be held neatly and in order. This property with its ease of operation will be a welcomed innovation to the kitchen.

The base, which is a necessary part of this invention can vary in diameter and size. It can be simple or made to accommodate a salt and pepper cellar etc. The base can be placed on a turntable type operation. The plates can vary in size and shape to achieve a desired appearance. The tension spring will insure that the proper force is maintained to keep the plates firmly against the base. The locking devise is used to prevent the bolt from loosening or tightening with use. This should be made so that it can be removed for later adjustments. Use of a hexagon head on bolt 13 can be used with a hexagon seat, so that the bolt will not loosen on use.

Once the proper adjustment is obtained a collar can be inserted over it to prevent it from rotating. This collar can be removed if any adjustments become necessary. Anything that will hold a constant tension can be used in place of the nut, bolt, tension spring and washers. The holder and base could be made of plastic, metal, wood or any type of workable material. One not having too much surface friction, like plastic would probably work best for this purpose.

A locking device incorporating a pin, or similar object at the end of the plate, which can be lowered into the base to hold the plates immovable to the base.

CONCLUSION

Thus it is clear that this invention, although extremely simple in its operation, will achieve the practicality and neatness which to date has not been accomplished with the common napkin holder. This has been done without changing the aesthetic looks of the holder. This operation could be used for other type holders. The plates and base could be modified to lock them into position at different openings. This can be done by attaching a pin at the end of the plate. These pins can be lowered into preset holes in the base, locking the plate into an immovable position.

I claim:

1. A holder for sheet material to be dispensed, comprising:

(a) a base;

(b) first and second plates mounted perpendicular to the base, and attached to the base, each with a single fastener;

(c) one fastener offset, between the right end and center of the first plate and another fastener offset between the left end and center of the second plate, allowing the plates to open when rotated in one direction so that sheet materials can be easily inserted, and to close when rotated in the opposite direction to hold the sheet materials upright and snug.

2. The holder in claim 1, wherein each fastener incorporates a biasing means to maintain the necessary and constant pressure for the proper functioning of said holder.

3. The holder of claim 1 wherein protrusions are attached to the plates, said protrusions located on the right side of the second plate and on the left side of the first plate to facilitate the opening and closing of the plates.

4. The of claim 1 including a locking device, said locking device attached to the plates and lowerable into the base, locking said plates into position and rendering the plates immovable at various size openings, until they are retracted.

* * * * *